United States Patent [19]

Noguchi

[11] Patent Number: 4,905,894

[45] Date of Patent: Mar. 6, 1990

[54] REFRIGERANT HEATING TYPE AIR CONDITIONER

[75] Inventor: Haruo Noguchi, Fuji, Japan

[73] Assignee: Kabushiki Kaisha Toshiba, Kawasaki, Japan

[21] Appl. No.: 260,037

[22] Filed: Oct. 20, 1988

[30] Foreign Application Priority Data

Oct. 23, 1987 [JP] Japan ..... 62-267978

[51] Int. Cl.[4] ..... G05D 23/00; F25B 29/00; F25B 27/00

[52] U.S. Cl. ..... 237/2 B; 236/91 F; 236/20 R; 236/78 B; 62/238.7; 62/160; 165/29

[58] Field of Search ..... 165/29; 62/160, 276, 62/238.6, 238.7; 236/91 F, 78 B, 20 R; 237/2 B

[56] References Cited

U.S. PATENT DOCUMENTS 4,441,331 4/1984 Yuyama ..... 165/29
4,441,901 4/1984 Endoh ..... 165/29
4,482,008 11/1984 Nomaguchi et al. ..... 62/160
4,506,521 3/1985 Asano et al. ..... 62/238.7
4,535,931 8/1985 Bartok et al. ..... 236/20 R
4,750,452 6/1988 Trihey et al. ..... 236/20 R

FOREIGN PATENT DOCUMENTS 0165825 12/1981 Japan ..... 236/20 R

*Primary Examiner*—John Ford
*Attorney, Agent, or Firm*—Foley & Lardner, Schwartz, Jeffery, Schwaab, Mack, Blumenthal & Evans

[57] ABSTRACT

The delivery side of a refrigerant compressor is connected through an inside heat exchanger to a refrigerant heater, the outlet side of the refrigerant heater being connected with the suction side of the compressor. First and second temperature sensors are provided at inlet and outlet sides of the refrigerant heater, respectively for sensing inlet and outlet refrigerant temperatures. A fuel gas supply unit for the refrigerant heater is fitted with a fuel gas control value which is controlled by the temperature differences existing between sensed temperatures by the first and second sensors.

1 Claim, 2 Drawing Sheets

REFRIGERANT HEATING TYPE AIR CONDITIONER

BACKGROUND OF THE INVENTION

1. Field of the Invention

This invention relates generally to a refrigerant heating type air conditioner, and more specifically to improvements in and relating to the above type of air conditioner in such a way as to provide the least possible refrigerant temperature fluctuation in the indoor side or the inside heat exchanger during a room air heating operation stage of the air conditioner and/or highly adapted for preventing otherwise possible excessive heating of the refrigerant heater, as may frequently occur at the starting-up period of the room air heating operation.

2. Prior Art

As is very well known to those skilled in the art, the delivery side of the refrigerant compressor employed in the system or the above kind of refrigerant heating type room air conditioner is generally connected to the refrigerant heater through the indoor side or the inside heat exchanger, while the outlet side of the said heater is connected with the suction side of the compressor. In this case, the high pressure, high temperature gaseous refrigerant delivered from the compressor has heat released, in the inside heat exchanger, in the form of condensing heat and then, subjected to a pressure reduction by passing through an expansion valve, is returned to the compressor. The liquefied refrigerant is heated up at the refrigerant heater for evaporation. If, at this stage, the temperature of the refrigerant heater should rise excessively, a temperature sensor provided at the outlet side of the refrigerant heater senses this and, in response to the correspondingly changed output signal therefrom, a fuel control valve attached to the heater is caused to close at a predetermined valve closing speed to decrease the fuel gas combustion rate.

In the case of the starting-up operation in the room air heating stage of the refrigerant heating type air conditioner of the above kind, the specific volume of the gaseous refrigerant sucked by the compressor is comparatively large, thus the quantity of refrigerant circulating for practical purposes is correspondingly small, therefore frequent overheating of the refrigerant heater and excessive outlet temperature increase thereat are disadvantageously invited.

Conventionally, such excessive temperature rises as frequently encountered at the refrigerant heater, as described above, are sensed by a temperature sensor provided at the outlet of the refrigerant heater, for controlling the fuel gas combustion rate, as will be described hereinafter more in detail with reference to FIG. 4.

Briefly, in other words, it is necessary to control the ON-OFF operation of the fuel control valve in such a way that when the refrigerant temperature at the refrigerant heater just arrives at a predetermined release operative temperature T1 destined for decreasing the fuel gas combustion rate, the fuel combustion rate reducing operation is introduced, and further, the fuel combustion per se is provisionally ceased when the temperature at the refrigerant heater exceeds a predetermined fuel combustion stopping temperature T0 and finally, the fuel combustion operation is reinstated when the refrigerant heater temperature arrives at a predetermined returning temperature T2.

However, in the case of the aforementioned conventional ON-OFF control mode of the control valve, a grave drawback has been found in that the refrigerant heater temperature cannot rapidly lower as desired, thereby disadvantageously inducing excessive heating of the heater when the fuel gas combustion rate reducing velocity as adopted after the execution of the sensing operation of the release temperature T1 has been conventionally preset to be equal to that in the regular and steady operation of the system, by virtue of a generally large thermal performance demand of the indoor or inside heat exchanger per se, and indeed, in comparison with the generally small amount of refrigerant circulation therethrough at the start-up stage of air heating mode operation of the air conditioner.

SUMMARY OF THE INVENTION

It is therefore an object of the present invention to provide an improved refrigerant heating type air conditioning system, that is capable of operating in a highly efficient and punctual manner.

A further object is to provide a highly superior refrigerant-heating type air conditioner, substantially devoid of conventionally experienced excessive heating troubles as frequently occur with refrigerant heaters.

For the fulfilment of the foregoing and further objects, such an improved air conditioner is proposed according to the present invention in that the delivery side of a refrigerant compressor is connected through the indoor side or inside heat exchanger to a refrigerant heater, the outlet side of the latter being connected with the suction side of said compressor, said air conditioner characterized in that, first and second temperature sensors are provided at inlet and outlet sides of said refrigerant heater, respectively, for sensing inlet and outlet refrigerant temperatures, and further, a fuel gas supply unit for said refrigerant heater is fitted with a fuel gas control valve which is controlled by the temperature difference existing between sensed temperatures by the first and second sensors and by and upon sensing that the outlet refrigerant temperature of said refrigerant heater has reached a predetermined release temperature.

According to the present invention, the outlet refrigerant temperature is sensed by the temperature sensor provided at the outlet side of the refrigerant heater at the start-up period in the air heating mode operation of the air conditioner, for determination of the temperature difference between the outlet temperature and the inlet refrigerant temperature sensed by the sensor provided at the inlet side of the refrigerant heater, and when the thus determined temperature difference is larger than a predetermined preset value, it is determined that the refrigerant circulation rate is lower than that desired, and then the velocity reduction of the fuel gas combustion rate is set to a larger value adapted for the prevention of otherwise possible overheating of the refrigerant heater.

On the other hand, if the outlet temperature of the refrigerant heater should arrive at the release temperature T1 by virtue of load fluctuations or the like as met during normal operation period of the air conditioner, it is acknowledged that fluctuations of the refrigerant heater outlet temperature are rather moderate and slower so that the fuel gas control valve is closed at a rather slower velocity adapted for limiting the velocity reduction of fuel gas combustion rate to a small value.

It will be clear that according to the present invention, when a release operative temperature is sensed at the start-up operation stage of air heating service, which may be caused to take place by a lower refrigerant circulation rate, the lower degree of deceleration of the fuel gas combustion rate is adjusted to a higher value, for sufficient limitation of otherwise possibly excessive heating of refrigerant heater, while, on the other hand, if a release operative temperature caused by load fluctuations in the normal operation service is sensed, control is executed in such a way that the degree of deceleration of the fuel gas combustion rae is adjusted to a lower value so as to suppress otherwise possible excessive cyclic fluctuations.

These and further objects, features and advantages of the invention will become more apparent when reading the following detailed description of the present invention taken in conjunction with the detailed drawings, revealing substantially a preferred embodiment of the invention.

DESCRIPTION OF PREFERRED EMBODIMENTS

Referring now to the accompanying drawings, FIGS. 1 to 5, a preferred embodiment of the invention will be described in detail.

Figure 1:
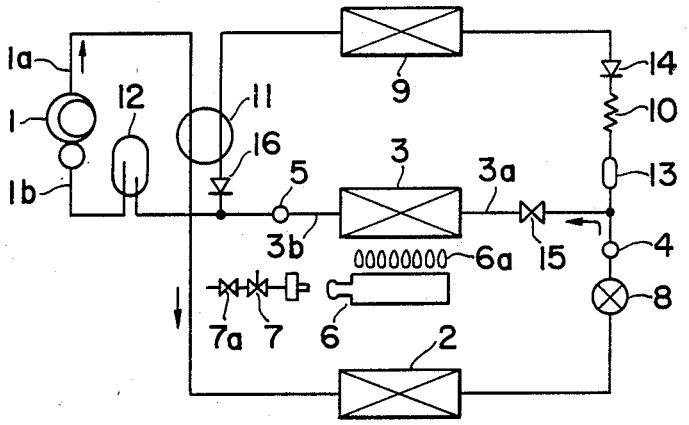
FIG. 1 is a schematic view of a refrigerant circulation system of the refrigerant heating type air conditioner according to the present invention.

FIG. 1 represents schematically a refrigerant circulation system providing a main portion of the refrigerant heating type of an air conditioning plant. As seen, in this refrigerant circulation system, the delivery side la of a refrigerant compressor 1 is connected through an inside heat exchanger 2 to a refrigerant heater 3 having inlet side 3*a* and outlet side 3*b*, arranged as shown. At these sides 3*a*, 3*b*, temperature sensors 4, 5 are provided for the measurement of respective refrigerant temperatures, as will be more fully described hereinafter. The refrigerant heater 3 is heated by gaseous flames 6*a* issuing from a series of perforations or nozzles (not shown) of a substantially tubular gas burner 6. The fuel supply rate of the burner 6 is automatically controlled by a control valve 7 fitted in the same fuel supply pipe leading to a fuel gas supply source (not shown). In proximity to the fuel supply control valve 7, a stop valve 7*a*, preferably of manual operation type, is fitted in the conventional manner. The control valve 7 is operated automatically in response to the heater outlet temperature as well as the temperature difference measured between temperature sensors 4 and 5, and appearing at a temperature difference detector 18, FIG. 2, as will be more fully described hereinafter.

Additionally, in FIG. 1, numeral 8 represents an expansion valve; 9, an outside heat exchanger and 10, a capillary tube. Further, 11, represents a four way valve; 12, an accumulator; 13, a dryer; 14, a check valve; 15, a two way valve; and 16, a check valve.

Figure 2:
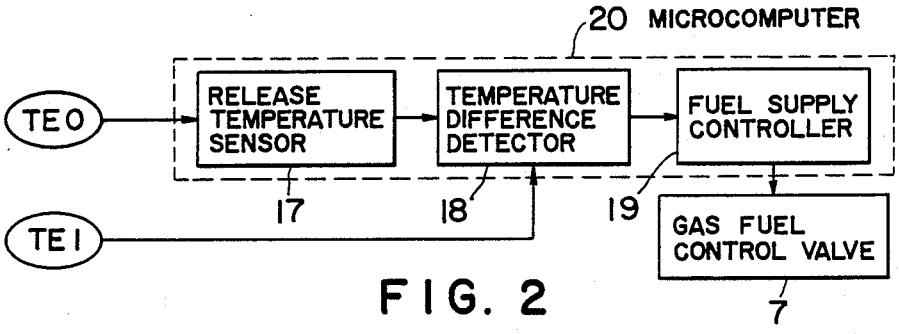
FIG. 2 is a block diagram, showing several main control elements adopted in the air conditioner.

FIG. 2 schematically represents a block diagram of the control arrangement included in the refrigerant heating type air conditioner. In fact, however, a certain signal processing step and gaseous fuel feed rate control step are additionally demonstrated only for the purpose of illustration.

In this block diagram, symbol TEI represents the output signal from the inlet side temperature sensor 4, while symbol TEO is for the output signal from the outlet side temperature sensor 5 arranged relative to the refrigerant heater 3, as has been already described. The sensed outlet temperature signal TEO is conveyed through a release temperature sensor 17 to a temperature difference detector 18. On the other hand, the sensed inlet temperature from sensor 4 is conveyed similarly to the detector 18. In this way, both these output signals TEI and TEO from the respective sensors are fed to a microcomputer 20 for the execution of operational comparison of both the signals, and the differential ΔTS thus determined, is then fed to a fuel supply controller 19, for control of the operation of the gas fuel control valve 6.

If the value of ΔTS should become higher than a certain predetermined level to reach the release temperature T1, a control signal is delivered which controls the opening degree of the gas fuel control valve 7 so as rapidly to reduce the degree of fuel burning degree for suppressing otherwise possible excessive overheating of the refrigerant at the refrigerant heater.

Figure 3:
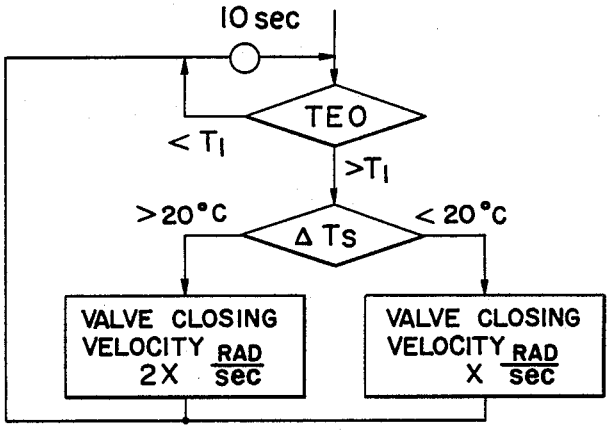
FIG. 3 is a flow chart of the air conditioner.

More specifically, an output signal from the inlet side temperature sensor 4 and another output signal from the output side temperature sensor 5 are fed to the microcomputer 20. If the sensed temperature at the former sensor 4 is lower than a certain predetermined release-operative temperature T1, as seen in FIG. 3, the operating conditions are maintained as before and for a predetermined short period of time, preferably ten seconds.

On the contrary, if the temperature TEO sensed at outlet side temperature sensor 5 is higher than the release operation temperature T1, a temperature difference ΔTS between the two sensed temperatures is determined by operational calculation in the microcomputer 20. If, further, the difference ΔTS is lower than a certain predetermined temperature value, say 20° C., the fuel supply rate-decreasing velocity of fuel control valve 7 is set to x radians/second. On the contrary, if the temperature difference ΔTS is higher than the predetermined temperature level, 20° C., the said fuel supply rate-decreasing velocity is set to 2X radians/second, as an example, so that the fuel combustion rate at the burner 6 is reduced to a corresponding lower level, in order to avoid otherwise possible extraordinary overheating at the refrigerant heater 6.

Figure 4:
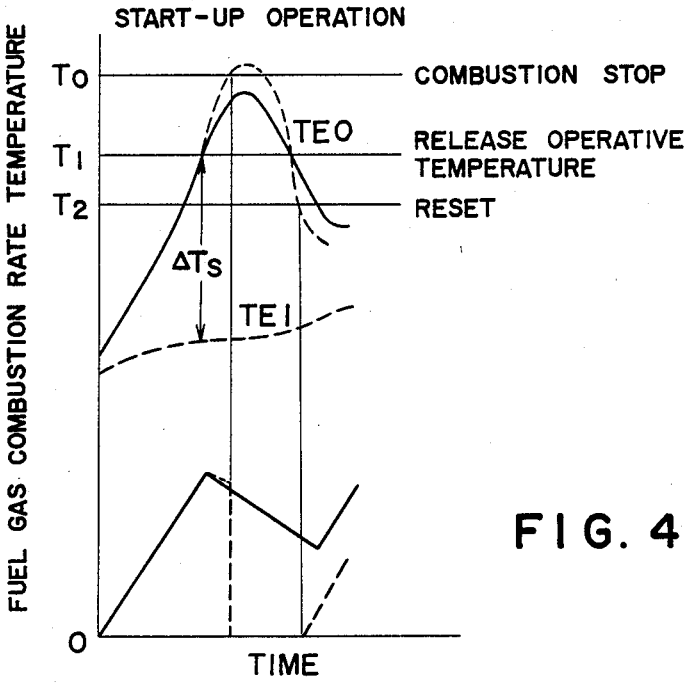
FIG. 4 is a characteristic diagram, showing the start-up state in the air heating mode operation of the air conditioner.

FIG. 4 is a diagram showing the relationship of the inlet side and outlet side temperatures relative to the refrigerant heater, on the one hand, and fuel gas combustion rate thereof, on the other hand, as appearing at start-up operation during the air heating stage of the air conditioner. In this stage, when the temperature difference ΔTS, as determined between the two differently sensed temperatures TEI and TEO becomes larger than a predetermined value, the deceleration velocity at gas fuel control valve 7 will be increased to twice the regular proportion valve closing velocity X radians/second. Therefore, the fuel combustion rate decreasing speed will become correspondingly higher, until at last when the sensed temperature at outlet side sensor 5 becomes lower than release resetting temperature T2, the gas fuel rate control valve 7 will return to its normal operating condition, so that the gas fuel consumption rate is increased than the hitherto one.

Figure 5:
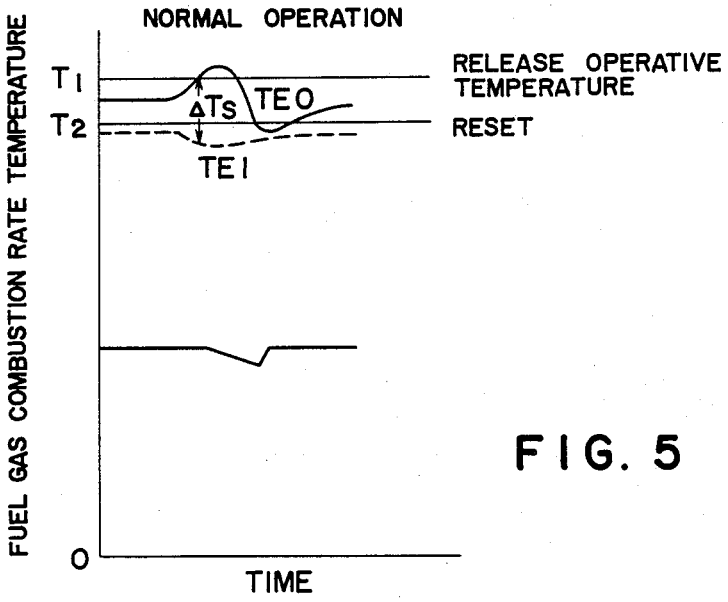
FIG. 5 is a further characteristic diagram, showing the characteristics of the air conditioner during its regular and normal operation period.

FIG. 5 illustrates only schematically the relationship between inlet and outlet temperatures of the refrigerant heater, on the one hand, and gas fuel consumption rate, on the other hand, as met at a load fluctuation stage under normal and steady operation condition. In this case, even if the sensed temperature TEO at the outlet side sensor 5 has risen up to the release initiation temperature T1, the operation will be gentle and moderate so that the valve opening degree decreasing speed of gas fuel control valve 7 will remain at the normal value X radians/second. In this way, therefore, excess and violent refrigerant cycle variation may be suppressed in a successful manner.

What is claimed is:

1. A refrigerant heating type air conditioner, in which a delivery side of a refrigerant gas compressor is connected through an inside heat exchanger to a refrigerant heater through an expansion valve, while an outlet side of said refrigerant heater is connected with a suction side of said compressor, said inside heat exchanger rejecting heat from the thus compressed high temperature, high pressure refrigerant gas delivered from said delivery side of said compressor in said inside heat exchanger, wherein the improvement comprises:

a first temperature sensor provided at an inlet side of said refrigerant heater for sensing the inlet temperature of the refrigerant, a second temperature sensor provided at said outlet side of said refrigerant heater for sensing the outlet temperature of said refrigerant, a fuel gas flow control valve fitted to a gas supplier for said refrigerant heater, and means for controlling said gas flow control valve in response to the temperature difference existing between the sensed temperatures by said first and second temperature sensors wherein, when said outlet refrigerant temperature at said refrigerant heater is higher than the release temperature and said temperature difference is higher than a predetermined value, said fuel gas control valve is subjected to a higher deceleration velocity towards valve closure, for reducing the fuel gas supply rate at a more rapid speed, and when said outlet refrigerant temperature at said refrigerant heater is higher than said release temperature and said temperature difference is lower than said predetermined value, said fuel gas supply rate is subjected to a slower deceleration velocity, for releasing the fuel gas supply rate at a less rapid speed.

* * * * *